US006551068B2

(12) United States Patent
Blotenberg

(10) Patent No.: US 6,551,068 B2
(45) Date of Patent: Apr. 22, 2003

(54) PROCESS FOR PROTECTING A TURBOCOMPRESSOR FROM OPERATING IN THE UNSTABLE WORKING RANGE

(75) Inventor: Wilfried Blotenberg, Dinslaken (DE)

(73) Assignee: Man Turbomaschinen AG GHH Borsig (DE)

( * ) Notice: Subject to any disclaimer, the term of this patent is extended or adjusted under 35 U.S.C. 154(b) by 0 days.

(21) Appl. No.: 09/803,070

(22) Filed: Mar. 9, 2001

(65) Prior Publication Data

US 2001/0022938 A1 Sep. 20, 2001

(30) Foreign Application Priority Data

Mar. 14, 2000 (DE) ..... 100 12 380

(51) Int. Cl.[7] ..... F04B 49/03

(52) U.S. Cl. ..... 417/53; 415/1; 415/17; 415/27; 417/279; 417/282

(58) Field of Search ..... 417/53, 279, 282; 415/1, 17, 26, 27, 28, 47, 48

(56) References Cited

U.S. PATENT DOCUMENTS

| | | | | |
|---|---|---|---|---|
| 3,276,674 A | | 10/1966 | Hens | 230/115 |
| 4,203,701 A | | 5/1980 | Abbey | 415/1 |
| 4,363,596 A | | 12/1982 | Watson et al. | 415/1 |
| 4,594,051 A | * | 6/1986 | Gaston | 374/10 |
| 4,949,276 A | * | 8/1990 | Staroselsky et al. | 415/1 |
| 5,306,116 A | * | 4/1994 | Gunn et al. | 415/17 |
| 5,765,991 A | | 6/1998 | Blotenberg | 415/26 |
| 5,915,917 A | * | 6/1999 | Eveker et al. | 415/1 |

FOREIGN PATENT DOCUMENTS

| | | |
|---|---|---|
| DE | 198 16 987 A1 | 2/2000 |
| DE | 198 60 639 A1 | 7/2000 |
| EP | 0 335 105 B1 | 10/1989 |
| EP | 0 500 195 | 8/1992 |

* cited by examiner

*Primary Examiner*—Charles G. Freay
*Assistant Examiner*—Emmanuel Sayoc
(74) *Attorney, Agent, or Firm*—McGlew and Tuttle, P.C.

(57) ABSTRACT

To protect a turbocompressor (3) with a downstream process from operation in the unstable working range, a machine controller is used, which optionally contains—besides a surge limit controller (15)—an intake pressure controller (11), an end pressure controller (20) and a bypass controller (9). A control matrix is determined from the position of a control unit (fuel gas control valve 6) determining the flow to the process, optionally taking into account additional influencing variables such as the compressor intake pressure and the compressor discharge pressure. The necessary position of the surge limit control valve (13) as well as of the bypass valve (8), of the intake pressure control valve (10) and of the actuating drive (22) for the compressor inlet vanes (21) is determined directly on the basis of the control matrix during a rapid transient change in the working position, and this actuating variable is directly superimposed as a manipulated variable to the surge limit control valve (13), the intake pressure controller (11), the end pressure controller (20) and the bypass controller (9).

40 Claims, 1 Drawing Sheet

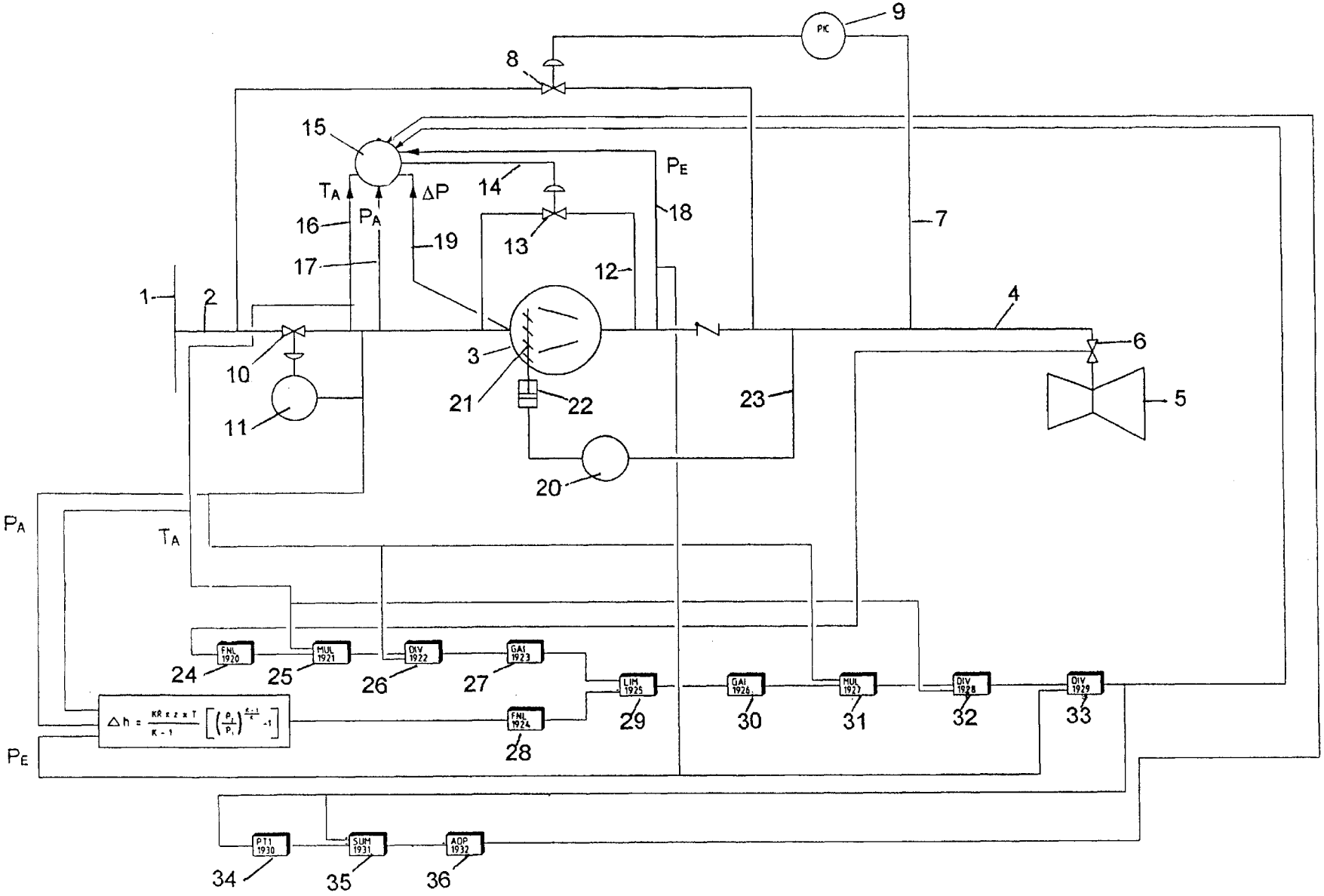
PK
DIV 1929
DIV 1928
MUL 1927
GAI 1926
LIM 1925
GAI 1923
FNL 1924
DIV 1922
MUL 1921
FNL 1920
ADP 1932
SUM 1931
PTI 1930
PE
PA
TA
ΔP
Δh = KR z x T / K - 1 [(P_A/P_E)^((K-1)/K) - 1]

PROCESS FOR PROTECTING A TURBOCOMPRESSOR FROM OPERATING IN THE UNSTABLE WORKING RANGE

FIELD OF THE INVENTION

The present invention pertains to a process for protecting a turbocompressor from operating in the unstable working range with a machine controller, which includes a surge limit controller and at least one of an intake pressure controller, an end pressure controller and a bypass controller, which performs an adjustment of a surge limit control valve and optionally of a said bypass valve, of an intake pressure control valve and of an actuating drive for compressor inlet vanes, which adjustment is controlled as a function of measured variables in the compressor inlet and the compressor outlet,.

BACKGROUND OF THE INVENTION

An unstable state of a turbocompressor, in which gas being delivered flows jerkily or periodically back from the delivery side to the intake side, is called pumping. This unstable state appears at an excessively high end pressure and/or at an excessively low throughput. A line, which separates the stable range from the unstable range and is called the surge limit, can therefore be unambiguously defined in the characteristic diagram determined by the end pressure and the throughput or by coordinates derived therefrom. The working point of the turbocompressor is prevented by means of the surge limit controller from reaching the surge limit and pumping and the resulting pumping is thus prevented from developing. A control line is set for this purpose in the characteristic diagram at a safety distance from the surge limit. When the working point exceeds the control line, a relief valve (surge limit control valve) branching off from the compressor outlet is opened more or less widely in order to blow off medium being delivered or to blow it over to the intake side and to lower the end pressure and to increase the throughput as a result.

Control methods for avoiding the pumping of the compressor have been known according to which the position of the compressor working point in the characteristic diagram relative to the stability limit (surge limit) is determined by measuring variables in the inlet and outlet of the compressor (pressure, temperature, throughput) and control signals for adjusting surge limit control valves (blow-off or blow-by valves) are derived from this. The throughput through the turbocompressor as well as the pressure and the temperature at the inlet and the outlet of the turbocompressor are decisive for the operation of the turbocompressor. The measuring points are therefore always selected as close to the turbocompressor as possible.

The known prior art deals with measures whose goal is to recognize a shift of the working point in the direction of the surge limit early and to respond to it anticipatorily. Other measures have the goal of linearizing nonlinearities of the control circuit in order to obtain an optimal response behavior of the control system in all working ranges.

EP-PS 335 105 describes a process which [is intended to] detect a disturbance and to respond to same by measuring a process disturbance as close to the site at which it is generated as possible, i.e., as far away from the turbocompressor as possible. This patent assumes that a disturbance can be detected by measurement sooner at the site at which it is generated than at the turbocompressor proper and that a time lead is obtained as a result, which has a favorable effect on the control behavior. However, this patent also uses the measured data obtained close to the site at which the disturbance is generated only to treat them in exactly the same manner as the measured variables which are measured directly on the turbocompressor. The measured variables are used in a closed control circuit. However, this process has the drawback that it requires a deviation in order to bring about a change in the output variable.

SUMMARY AND OBJECTS OF THE INVENTION

The basic object of the present invention is to design the process of this type such that the unstable state of the turbocompressor can be detected and eliminated more reliably and rapidly.

According to the invention, a process is provided for protecting a turbocompressor with a downstream process from operation in the unstable working range. The process uses a machine controller, which optionally contains, besides a surge limit controller a intake pressure controller, an end pressure controller, a bypass controller, which performs an adjustment of a surge limit control valve and optionally of a bypass valve, of an intake pressure control valve and of an actuating drive for the compressor inlet vanes, which adjustment is controlled as a function of measured variables in the compressor inlet and the compressor outlet. A control matrix is determined from the position of a control unit (e.g., the fuel gas control valve), optionally taking into account additional influencing variables such as the compressor end pressure and the compressor outlet pressure and the compressor intake temperature as well as the process pressure. The control matrix is stored in the machine controller. The necessary position of the surge limit control valve as well as of the bypass valve, of the intake pressure control valve and of the actuating drive for the compressor inlet vanes is determined directly on the basis of this control matrix during a rapid transient change in the working point. This actuating variable is directly superimposed as a manipulated variable to the surge limit control valve, the intake pressure controller, the end pressure controller and the bypass controller.

The essential idea of the present invention is to calculate a variable from a measurement of the flow to the process as close to the process as possible, which variable corresponds to the future flow through the turbocompressor, and to derive from this measured variable a correction variable which directly actuates the surge limit control valve of the turbocompressor. It becomes possible in this manner to anticipatorily open the surge limit control valve before operation in the unstable working range for the protection of the turbocompressor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The drawing is a flow diagram of a process for the protection of a turbocompressor from operation in the unstable working range.

DESCRIPTION OF THE PREFERRED EMBODIMENT

Referring to the drawings in particular, a fuel gas is taken from a pipeline 1 via a fuel gas line 2, compressed in a turbocompressor 3 from, e.g., a 25-bar pipeline pressure to a pressure of 52 bar and is fed to a gas turbine 5 via a discharge line 4. A fuel gas control valve 6 is provided in the discharge line 4 before the entry into the gas turbine 5.

In the case of greatly varying inlet pressures, the turbocompressor 3 may be preceded by an intake pressure control valve 10 in the fuel gas line 2. The task of this intake pressure control valve 10 is to maintain a constant inlet pressure for the turbocompressor 3 by means of an intake pressure controller 11 in the case of varying pipeline pressure.

The compressor outlet pressure is controlled by an end pressure controller 20 to constant values by the compressor inlet guide vanes 21 being adjusted by means of an actuating drive 22. The end pressure is measured by means of a pressure sensor and transmitted via a signal line 23. As designed, the compressor inlet guide vanes 21 may travel over the entire adjusting stroke within 15 to 60 sec.

Should the pipeline pressure be able to rise to values above the necessary gas turbine inlet pressure, a bypass line 7 is provided, which bypasses the turbocompressor 3 and in which a bypass valve 8 is arranged. This bypass line 7 can supply the gas turbine 5 with fuel gas directly, bypassing the turbocompressor 3, when the pipeline pressure is above the necessary compressor outlet pressure which is generated by the turbocompressor 3. The bypass valve 8 is connected to a bypass pressure controller 9.

A blow-by line 12, which is returned into the fuel gas line 2 before the turbocompressor 3, is branched off from the discharge line 4 after the turbocompressor 3. A blow-by or surge limit control valve 13, which is connected to a surge limit controller 15 via a control line 14, is arranged in the blow-by line 12. The fuel gas can be blown by via this blow-by line 12 to the intake side of the turbocompressor 3.

A temperature sensor for detecting the intake temperature $T_A$ of the fuel gas as well as a pressure sensor for measuring the intake pressure $P_A$ are arranged in the fuel gas line 2, and a pressure sensor for measuring the compressor outlet pressure $P_E$ is arranged in the discharge line 4. These measuring means are connected to the surge limit control valve 15 via measuring lines 16, 17, 18. Furthermore, the pressure difference $\Delta P$ is determined at the compressor inlet at a throttling point. The throttling point is likewise connected to the surge limit control valve 15 via a measuring line 19.

The fuel gas control valve 6 of the gas turbine 5 can close in about 0.1 sec. Consequently, the fuel gas flow can also be reduced from the nominal value to zero within this time. During a load decrease of the generator driven by the gas turbine 5, the fuel gas flow must be able to be reduced, e.g., within 0.1 sec to a few percent. However, the fuel gas pressure must be maintained at the nominal value in order to be able to continue to operate the gas turbine 5.

In the prior-art control process, the intake flow into the turbocompressor 3 and the enthalpy difference of the turbocompressor 3 is determined. To do so, the flow as well as the pressure in the compressor inlet and outlet as well as the temperature in the inlet of the turbocompressor 3 are measured and the enthalpy difference is calculated from this. Shortly after a load change of the gas turbine 5, the intake flow of the turbocompressor 3 will decrease and the enthalpy difference will rise because of the increasing end pressure. The working point of the compressor is moving in the direction of the surge limit. The end pressure controller 20 notices the increase and responds by closing the compressor inlet guide vanes 21. As a result, the compressor end pressure is maintained at constant values. However, the working point is approaching the surge limit.

If the flow through the gas turbine 5 continues to decrease, the working point can reach the control line located before the surge limit. The surge limit control of the turbocompressor 3 now responds to a further shift in the working point and opens the surge limit control valve 13 from the delivery side to the intake side of the turbocompressor 3. Depending on how fast the controller can respond, the consequence is a corresponding increase in the fuel gas pressure. The pressure will possibly increase to the extent that the gas turbine 5 must be switched off completely for safety reasons.

A prior-art control process utilizes the surge limit control valve 13 to maintain the compressor end pressure at a constant value during a load reduction of the gas turbine 5. The surge limit controller 15 receives in this process an end pressure limiting control, which opens the surge limit control valve 13 during an increase in the compressor end pressure such that the end pressure is maintained at a constant value. The set point of this end pressure limiting controller is slightly above the set point of the end pressure controller 20, so that this stationarily closes the compressor inlet guide vanes 21 to the extent that the blow-by valve is completely closed.

According to another prior-art approach, a compressor relief valve opens as the load of the gas turbine 5 decreases. However, the consequence of this is that either too little gas or too much gas is blown by the turbocompressor 3, especially if the fact that the gas turbine 5 may have been operated at any load point with any fuel gas flow before the onset of the load decrease is taken into account. The consequence of this is that the pressure will either increase or decrease appreciably in modes of operation outside the design point. Both have the same adverse effect on the fuel gas pressure and on the operation of the gas turbine 5.

A markedly better control behavior can be obtained with the process according to the present invention. If the fuel gas control valve 6 assumes another position in this control process, this leads to a changed fuel gas flow to the gas turbine 5. The flow through the turbocompressor 3 will also decrease with an offset in time in order to assume a new steady state value, which becomes established as a direct consequence of the change in the position of the fuel gas control valve. The amount of fuel gas no longer absorbed by the gas turbine 5 must be blown off via the blow-by line 12. Instead of waiting for a measurable change in the parameters pressure before and after the turbocompressor 3 or the flow in the turbocompressor 3, a manipulated variable for the surge limit control valve 13 can be directly derived from the position of the fuel gas control valve 6. This correcting variable is available considerably sooner than the measured change in the intake flow and the end pressure or the enthalpy difference. It is even possible with this process to completely avoid a change in the fuel gas pressure.

The mass flow through the fuel gas control valve 6 is determined in a resolver transmitter 24 (FNL 1920) from the position of the fuel gas control valve 6. If the fuel gas control valve 6 has a linear characteristic and if the pressure before and after the fuel gas control valve 6 is constant (which is normally the case), it is acceptable not to take into account these variables. If the fuel gas control valve 6 has a linear characteristic, only the course of a straight line is to be entered in this resolver transmitter 24 (FNL 1920). In case of nonlinear characteristics, the course of the characteristic may be stored as a progression or a formula. If the pressure or the temperature before and after the fuel gas control valve 6 are variable, the current mass flow can be calculated from the known dimensioning equations for control valves by taking into account these variables.

The volume flow in the compressor inlet is calculated in a multiplier 25 (MUL 1921) and a divider 26 (DIV 1922) by multiplication by the compressor intake temperature $T_A$ and division by the intake pressure $P_A$. A scaling factor for fitting to the measurement range may be introduced in an amplifier 27 (GAI 1923).

Another resolver transmitter 28 (FNL 1924) determines the course of the surge limit or the control line (blow-by line, blow-off line) of the surge limit controller 15 from the enthalpy difference Δh. The enthalpy difference is calculated as a function of the compressor outlet pressure $P_E$, the intake pressure $P_A$ and the intake temperature $T_A$ in the surge limit controller 15 and is available there.

The output of the amplifier 27 (GAI 1923) describes the intake volume flow, which becomes established in the compressor inlet when the current mode of operation is preserved until the steady state is reached. The output of the resolver transmitter 28 (FNL 1924) describes the corresponding flow at the surge limit and at the control line. Whether or not the turbocompressor 3 can deliver the flow to the gas turbine 5 without blow-by can be determined from the difference of these two variables. If the flow (output of the amplifier 27 (GAI 1923)) is greater than the flow at the surge limit (output of the resolver transmitter 28 (FNL 1924)), no action is necessary. If the output of the amplifier 27 (GAI 1923) is lower than that of the resolver transmitter 27 (FNL 1924), the difference must be blown by via the blow-by line 12 through the surge limit control valve 13 from the delivery side to the intake side in order for the turbocompressor 3 to be operated at the surge limit or on the control line and for the gas turbine 5 to nevertheless receive the reduced amount of gas at constant pressure.

A limiter 29 (LIM 1925) has a limiting function. It lets through only negative values and limits positive values to zero. Thus, an actuating variable is generated only if the difference is negative, i.e., the surge limit control valve 13 must open in order to be able to operate the turbocompressor 3 in a stable manner in the characteristic diagram.

The flow through the surge limit control valve 13 is determined essentially by the position of the surge limit control valve 13 and the pressure before the surge limit control valve 13. The pressure before the surge limit control valve 13 is largely identical to the compressor end pressure. An amplifier 30 (GAI 1926) makes possible scaling which may possibly be necessary, and a multiplier 31 (MUL 1927) and a divider 32 (DIV 1928) determine the corresponding mass flow by multiplication by the intake pressure $P_A$ and division by the intake temperature $T_A$. The corresponding opening of the surge limit control valve 13 is determined from this by division by the compressor end pressure $P_E$ in a divider 33 (DIV 1929).

The task of this actuating variable is consequently only to bring about a corresponding adjustment of the surge limit control valve 13 during a change in the output of the divider 33 (DIV 1929). The output of the divider 33 (DIV 1929) can be added directly to the output of the surge limit controller 15.

Should the characteristic of the surge limit control valve 13 be nonlinear or the pressure or the temperature before or after the surge limit control valve be variable, the necessary opening of the surge limit control valve 13 can be determined by using the known dimensioning equations for control valves.

The actuating variable can determine the set point of the position for the surge limit control valve 13 either directly and exclusively. This process has the advantage that the turbocompressor 3 is always operated at the same working point and it is thus ensured that the fuel gas pressure in the outlet of the turbocompressor 3 is also always maintained at a constant value. However, preference should be given to a process in which the actuating variable acts in addition to the surge limit controller 15 and the actuating variable is either added to the output of the surge limit controller 15 or is superimposed to the control signal of the controller in one of the manners described below.

The actuating variable and the output signal of the surge limit controller 15 of the prior-art design are added to one another, and the sum of the two variables forms the set point for the surge limit control valve 13. If such a process is used, additional measures are necessary to prevent the output of the surge limit controller 15 from overdriving. The surge limit controller 15 and the surge limit control valve 13 must have a mutually corresponding signal range, e.g., 4 mA to 20 mA. The value of 4 mA corresponds to the minimum output signal of the surge limit controller 15 and the value of 20 mA corresponds to the maximum output signal. The surge limit control valve 13 is fully open at a value of 4 mA and fully closed at a value of 20 mA. It is ensured by limiting measures in the output of the surge limit controller 15 that the manipulated variable of the surge limit controller 15 cannot exceed the value of 20 mA and cannot be lower than the value of 4 mA. It is not sufficient to limit the manipulated variable in the output, but the integral part of the surge limit controller 15 is to be limited such that even in the case of greater permanent deviations, it will always assume only such values that the addition of the integral part and the proportional part will not exceed nor drop below the permissible limits.

If an actuating variable is now added to the (limited) output of the surge limit controller 15, this causes the limitations of the integral part in the surge limit controller 15 to act incorrectly. The sum of the controller output and the actuating variable may either exceed 20 mA or drop below 4 mA. To prevent this from happening, additional measures are necessary according to the present invention.

One possible measure is to always adjust the limits of the integral part of the surge limit controller 15, taking into account the actuating variable, such that the limits can be reached but not exceeded.

Another possibility is to adjust the integral part of the surge limit controller 15 during a deviation between the controller output and the valve position such that the deviation becomes zero. This is advantageously accomplished such that the adjustment will always take place only when the difference between the valve position and the manipulated variable exceeds a limit value. It is thus ensured that the integral part cannot deviate from the position of the surge limit control valve 13 to an unacceptably great extent even if the limits are selected incorrectly and the limitation of the valve actuating drive is ultimately selected as the only active limit.

An alternative solution is to make the actuating variable dynamic. Instead of processing a constant actuating variable during a displacement of the working point into a new stationary working point closer to the surge limit, the actuating variable is made flexible. This is accomplished by the flexible summation in the time element 34 (PT1 1930) and the adder 35 (SUM 1931).

As long as the output of the divider 33 (DIV 1929) is stationary, both inputs of the adder 25 (SUM 1931) are equal in terms of value because the output of the time element 34 (PT1 1930) corresponds to its input after the decay of the build-up process. If the signal of the divider 33 (DIV 1929) now changes dynamically, the output of the time element 34 (PT1 1930) follows with a delay only. The adder 35 (SUM 1931) temporarily sees a signal deviating from zero, which is sent to the surge limit controller 15, and this signal stationarily becomes zero. The output of the adder 35 (SUM 1931) can be added directly to the output of the surge limit controller 15.

According to another alternative solution, the upper limit of the surge limit controller 15 is set adaptively at the value "100% minus actuating variable" (output of the adder 35 (SUM 1931)). The surge limit controller 15 can then assume only this value as the maximum. It should be borne in mind in this connection that the surge limit controller 15 has completely closed the surge limit control valve 13 at the maximum output signal "100%" and has fully opened it at the minimum output signal "0". The output of the surge limit controller 15 is 100% and the surge limit control valve 13 is closed during normal operation. Consequently, a reduction of the upper limit of the surge limit controller output signal inevitably leads to a corresponding opening of the surge limit control valve 13. At the same time, the lower limit of the surge limit controller 15 can also be adapted to the actuating variable (block 36 (ADP 1932)).

The limitation of the actuating variable in the output of the limiter 29 (LIM 1925) causes that an actuating variable signal is sent and consequently the surge limit control valve 13 is opened only when the new working point is located so far to the left in the characteristic diagram that the mass flow to the gas turbine 5 is smaller than the minimum allowable compressor mass flow. The surge limit control valve 13 remains closed in all other cases, i.e., when the target is located to the right of the control line.

However, it may also be definitely desirable to intercept any rapid change in flow through the fuel gas control valve 6 by means of the surge limit control valve 13, because the surge limit control valve 13 normally has substantially shorter adjustment times (substantially higher speeds of adjustment) than the compressor guide vanes. The limitations in the limiter 29 (LIM 1925) are to be rendered ineffective in this case.

If an intake pressure control valve is used to reduce the compressor intake pressure at variable pipeline pressures in addition to the surge limit control valve 13, the same problem will arise in the case of sudden load changes of the gas turbine 5.

The opening of the intake pressure control valve 10 is a function of the pressure difference between the pipeline pressure and the compressor intake pressure as well as the flow through the intake pressure control valve 10. The intake pressure control valve 10 must close as the mass flow decreases at constant pressures. If the pipeline pressure increases at constant mass flow, the intake pressure control valve 10 must close and it must open at decreasing pipeline pressure.

Changes normally occur slowly in the pipeline pressure because there is a large storage volume. However, changes in the mass flow may take place rapidly, i.e., with a gradient of 100% change in 0.1 sec. The control behavior can be markedly improved according to the present invention in this case as well in the case of a rapid disturbance at the gas turbine 5. Taking into account the pipeline pressure, the necessary position of the intake pressure control valve 11 can be calculated directly from the position of the fuel gas control valve 6. The end pressure regulator 20 no longer needs to eliminate the entire disturbance but only the remaining control error. The manipulated variable (controller output) and the control signal are added up for this purpose. However, it must be ensured at the same time that the upper and lower limitations of the controller output signal are always shifted dynamically by the actuating variable, so that the adjustment range of 0 to 1 is always true for the sum of the actuating variable and the manipulated variable. The actuating variable may, of course, also be added dynamically to the controller output as was described for the surge limit controller 15.

The same considerations apply to the actuation of the bypass valve 8 as to the intake pressure control valve 10. The necessary extent of opening of the bypass valve 8 is proportional to the opening of the fuel gas control valve 6. If the fuel gas control valve 6 is opened wide, the gas turbine 5 needs much fuel and the bypass valve 8 must be opened wide in order to reach the necessary pressure drop between the pipeline pressure and the necessary fuel gas pressure before the gas turbine 5. The bypass valve 8 must close as the fuel gas demand decreases to generate the same pressure loss at a lower flow. In addition, the pipeline pressure also affects the opening of the bypass valve 8. The higher the pipeline pressure, the more widely must the bypass valve 8 close.

A bypass controller 9, whose output acts on the bypass valve 8, is usually used. Any change in the fuel gas demand causes a change in the pressure after the bypass valve 8. The bypass controller 9 responds to this change in pressure and correspondingly adjusts the bypass valve 8. During slow changes, this method leads to a sufficiently good control behavior. However, this may lead to undesirably great changes in the fuel gas pressure in the case of rapid changes in the load of the gas turbine 5. The remedy for this is the mixing according to the present invention of an actuating variable, determined from the position of the fuel gas control valve and the pipeline pressure, as was described for the intake pressure control valve.

The determination of the control matrices, i.e., of the dependence of the actuating variable on the variable process variables fuel gas flow and the position of the fuel gas control valve as well as pressures and temperatures before and after the valves, may be carried out in various ways.

Many complex technical systems are now dynamically simulated before they are embodied. To do so, the dynamic behavior of the components used is simulated in a computer program. Any system disturbances and operating conditions can be simulated on the computer before the plant is built. If such a simulation model exists, the control matrices can be determined by means of simulation. This can be carried out in the control process being described as follows. The position of the fuel gas control valve 6 is adjusted at increments of 10% each at maximum pipeline pressure. After reaching a stable working point, the pipeline pressure, the position of the fuel gas control valve 6, the position of the intake pressure control valve 10 and the position of the bypass valve 8 are noted. The pipeline pressure is then reduced by 10% and another data set is noted for all positions of the fuel gas control valve 6. After covering the entire range of the possible pipeline pressures, a three-dimensional allocation matrix is available for the position of the intake pressure control valve 10 and of the bypass valve 8 as a function of the measurable variables pipeline pressure and fuel gas control valve position. This allocation matrix must be stored in the surge limit controller 15. Linear interpolation is possible at pipeline pressures between restart points or fuel gas control valve positions between two restart points.

Instead of determining the allocation matrix per dynamic simulation, it is also possible to determine this after the installation of the plant. The plant must be brought for this purpose into the different working points and the measured variables are to be noted. The same allocation matrix is obtained as a result.

A third possibility is to theoretically calculate the allocation matrix using the thermodynamic and fluidic data of all plant components.

All the explanations given for the surge limit control at the beginning of this specification also apply, of course, to the regulation and the control of reducing valves and bypass valves.

While specific embodiments of the invention have been shown and described in detail to illustrate the application of the principles of the invention, it will be understood that the invention may be embodied otherwise without departing from such principles.

What is claimed is:

1. A process for protecting a turbocompressor from operation in the unstable working range, said turbocompressor having an inlet and an outlet and means for measuring variables including one or more of pressure and temperature at the inlet and at the outlet as measured variables, said turbocompressor being associated with a downstream process downstream of said turbocompressor, said downstream process having a flow generated by said turbocompressor, said flow being controlled by a turbocompressor gas throughput control valve, the process for protecting a turbocompressor, comprising the steps of:

using a machine controller having a surge limit controller with an associated surge limit control valve;

with the machine controller controlling the adjustment of the surge limit control valve as a function of the measured variables in the turbocompressor inlet and the turbocompressor outlet;

providing a predetermined control matrix for the purpose of controlling the turbocompressor at a target operating state from the position of the turbocompressor gas throughput control valve of the downstream process during turbocompressor operation, the control matrix being stored in the machine controller;

during a rapid transient change in the working point of the turbocompressor, determining the necessary position of the surge limit control valve directly on the basis of the control matrix to generate an actuating variable;

superimposing the actuating variable as a manipulated variable to the output of the surge limit controller of the machine controller.

2. A process for protecting a turbocompressor from operation in the unstable working range, said turbocompressor having an inlet and an outlet and means for measuring variables including pressure and temperature at the inlet and at the outlet as measured variables, said turbocompressor being associated with a downstream process downstream of said turbocompressor, said downstream process having a gas flow generated by said turbocompressor, said gas flow being controlled by a turbocompressor gas throughput control valve, the process for protecting a turbocompressor comprising the steps of:

using a machine controller having a surge limit controller with an associated surge limit control valve, an intake pressure controller with an associated intake pressure control valve, an end pressure controller with an associated end pressure control valve and a bypass controller with an associated bypass control valve;

with the machine controller controlling the adjustment of the surge limit control valve said intake pressure control valve, said bypass control valve and an actuating drive for turbocompressor inlet vanes of said turbocompressor as a function of the measured variables in the turbocompressor inlet and the turbocompressor outlet;

providing a predetermined control matrix for the purpose of controlling the turbocompressor at a target operating state from turbocompressor inlet and turbocompressor outlet variables and from the position of the turbocompressor gas throughput control valve of the downstream process during turbocompressor operation, the control matrix being stored in the machine controller;

during a rapid transient change in the working point of the turbocompressor, determining the necessary position of the surge limit control valve as well as of the bypass valve, of the intake pressure control valve and of the actuating drive for the turbocompressor inlet vanes directly on the basis of the control matrix to generate an actuating variable;

directly superimposing the actuating variable as a manipulated variable to the surge limit controller, the intake pressure controller, the end pressure controller and the bypass controller of the machine controller.

3. A process in accordance with claim 1, wherein said step of determining a control matrix takes into account the turbocompressor intake pressure and the turbocompressor outlet pressure and the turbocompressor intake temperature as well as the process pressure of the downstream process.

4. A process in accordance with claim 1, wherein the control matrix is determined by dynamic simulation.

5. A process in accordance wit claim 1, wherein the control matrix is determined by measuring the input and output variables by operating the turbocompressor.

6. A process in accordance with claim 1, wherein the control matrix is formed based on actual thermodynamic and fluidic data of the turbocompressor, to set relationships between the turbocompressor gas throughput control valve and machine controller and sensed variabled of the turbocompressor.

7. A process in accordance with claim 1, wherein the control matrix determines from the measured gas flow to the process an actuating variable for opening the surge limit control valve, said actuating variable being sent directly to the surge limit controller.

8. A process in accordance with claim 1, wherein the actuating variable acts on the surge limit controller only when the new working point of the turbocompressor is in the unstable working range.

9. A process accordance with claim 1, wherein when the actuating variable generated from the control matrix does not filly reach a target value that the actuating variable has to take, a feedback adjustment of the output of the surge limit control controller with superimposed actuating variable is provided until the target value is reached.

10. A process in accordance with claim 1, wherein the surge limit controller has an integral part and the actuating variable acts directly on the integral part of the surge limit controller and changes the integral part of the surge limit controller.

11. A process in accordance with claim 10, wherein the limits of the integral part of the surge limit controller are changed as a function of the actuating variable such that the sum of the surge limit controller output and the actuating variable cannot exceed the permissible limits of the range of adjustment of the surge limit control valve, but the full range of adjustment can be utilized at the same time.

12. A process in accordance with claim 1, wherein to determine the desired position of the surge limit control valves the pressure and the temperature before and after the surge limit control valve are measured and are introduced into the calculation of the control matrix such that the control matrix yields the necessary mass flow through the surge limit control valve and determines the necessary position of the surge limit control valve on the basis of the dimensioning equations for valves from the necessary mass flow, taking into account the pressure and the temperature before and after the surge limit control valve.

13. A process in accordance with claim 1, wherein the mass flow to the process is determined from the position of the turbocompressor gas throughput control valve, taking into account the pressure and the temperature before and after the turbocompressor gas throughput control valve and this mass flow is taken into account as the process mass flow.

14. A process in accordance with claim 1, wherein a feedback control adjusts the surge limit controller to a current valve position of the actuated surge limit control valve in the case of a deviation between said output of the surge limit controller and a position of the actuated surge limit control valve.

15. A process in accordance with claim 1, wherein the actuating variable acts wit a feedback reset function an the output of the surge limit controller and with no feedback decreases to the value zero.

16. A process in accordance with claim 1, further comprising:

using an intake pressure control valve arranged upstream of the turbocompressor, wherein said control matrix, whose output variable determines the position of the intake pressure control value, is additionally formed from the pipeline pressure and the flow to the process.

17. A process in accordance with claim 16, wherein the control matrix is determined by dynamic simulation.

18. A process in accordance with claim 16, wherein the control matrix is determined by measuring the input and output variables by operating the turbocompressor.

19. A process in accordance with claim 16, wherein the control matrix is formed based on actual thermodynamic and fluidic data of the turbocompressor, to set relationships between the flaw control valve and machine controller and sensed variabled of the turbocompressor.

20. A process in accordance with claim 16, wherein the control matrix determines from the position of the turbocompressor gas throughput control valve an actuating variable for opening the intake pressure control valve, which is directly sent to the intake pressure control valve.

21. A process in accordance with claim 16, wherein when the actuating variable generated from the control matrix does not fully reach a target value that the actuating variable has to take, a feedback adjustment of the output of the surge limit control controller with superimposed actuating variable is provided until the target value is reached.

22. A process in accordance with claim 16, wherein the surge limit controller has an integral part and the actuating variable acts directly ante integral part of the surge limit controller and changes the integral part of the surge limit controller.

23. A process in accordance with claim 22, wherein the limits of the integral part of the intake pressure controller are changed as a function of the actuating variable such that the sum of the intake pressure controller output and the actuating variable cannot exceed the permissible limits of the range of adjustment of the intake pressure control valve, but the full range of adjustment can be utilized at the same time.

24. A process in accordance with claim 16, wherein the pressure and the temperature before and after the intake pressure control valve are measured to determine the desired position of the intake pressure control valve and they are introduced into the calculation such that the control matrix yields the necessary mass flow through the intake pressure control valve and it determines the necessary position of the valve on the basis of the dimensioning equations for valves from the necessary mass flow, taking into account the pressure and the temperature before and after the intake pressure control valve.

25. A process in accordance with claim 16, wherein the actuating variable acts with a feedback reset function on the intake pressure controller and drops with no feedback to the value zero.

26. A process in accordance with claim 16, wherein the mass flow to the process is determined from the position of the turbocompressor gas throughput control valve taking into account the pressure and the temperature before and after the turbocompressor gas throughput control valve and this mass flow is taken into account as a process mass flow.

27. A process in accordance with claim 16, wherein a feedback control adjusts the intake pressure controller to a current position of the actuated intake pressure control valve in the case of a deviation between said output of the intake pressure controller and a position of the actuated intake pressure control valve.

28. A process in accordance with claim 1, further comprising the step of using a bypass valve bypassing the turbocompressor, wherein a control matrix, whose output variable determines the position of the bypass valve, is formed from the pipeline pressure and the flow to the process.

29. A process in accordance with claim 2, wherein the control matrix is determined by dynamic simulation.

30. A process in accordance with claim 28, wherein the control matrix is determined by measuring the input and output variables by operating the turbocompressor.

31. A process in accordance with claim 28, wherein the control matrix is formed based on actual thermodynamic and fluidic data of the turbocompressor, the turbocompressor gas throughput control valve and the machine controller.

32. A process in accordance with claim 28, wherein the control matrix determines from the position of a turbocompressor gas throughput control valve an actuating variable for opening the bypass valve, which is directly superimposed to the bypass valve.

33. A process in accordance with claim 28, wherein when the actuating variable generated from the control matrix does not fully reach a target value that the actuating variable has to take, a feedback adjustment of the output of the bypasss valve controller with superimposed actuating variable is provided until the target value is reached.

34. A process in accordance with claim 28, wherein the bypass controller has an integral part and the actuating variable acts directly on the integral part of the bypass controller and changes same the integral part of the bypass controller.

35. A process in accordance with claim 34, wherein the limits of the integral part of the bypass controller are changed as a function of the actuating variable such that the sum of the bypass controller output and the actuating variable cannot exceed the permissible limits of the range of adjustment of the bypass valve, but the full range of adjustment can be utilized at the same time.

36. A process in accordance with claim 28, wherein the pressure and the temperature before and after the bypass valve are measured to determine the desired position of the bypass valve and they are introduced into the calculation such that the control matrix yields the necessary mass flow through the bypass valve and determines the necessary position of the bypass valve on the basis of the dimensioning equations for valves from the necessary mass flow, taking into account the pressure and the temperature before and after the bypass valve.

37. A process in accordance with claim 28, wherein the actuating variable acts with a feedback reset function on the output of the bypass controller and decreases with no feedback to the value zero.

38. A process in accordance with claim 28, wherein the mass flow to the process is determined from the position of a turbocompressor gas throughput control valve taking into account the pressure and the temperature before and after the flue gas control valve and this mass flow is taken into account as the process mass flow.

39. A process in accordance with claim 28, wherein the bypass controller is adjusted to the current valve position of the bypass valve in the case of a deviation between the bypass controller output and the position of the bypass valve.

40. A process in accordance with claim 13, wherein the mass flow of the downstream process determined by a measurement.

* * * * *